US011326286B1

(12) United States Patent
Bowen et al.

(10) Patent No.: US 11,326,286 B1
(45) Date of Patent: May 10, 2022

(54) STITCH COUNTING DEVICE AND METHOD OF USE

(71) Applicants: Alexander S. Bowen, Parker, TX (US); Kimberly M. Bowen, Parker, TX (US)

(72) Inventors: Alexander S. Bowen, Parker, TX (US); Kimberly M. Bowen, Parker, TX (US)

( * ) Notice: Subject to any disclaimer, the term of this patent is extended or adjusted under 35 U.S.C. 154(b) by 0 days.

(21) Appl. No.: 17/207,275

(22) Filed: Mar. 19, 2021

(51) Int. Cl.
*D05C 1/00* (2006.01)
*D05B 91/00* (2006.01)
*D04B 3/00* (2006.01)

(52) U.S. Cl.
CPC ..... *D05C 1/00* (2013.01); *D04B 3/00* (2013.01); *D05B 91/00* (2013.01); *D05D 2305/345* (2013.01)

(58) Field of Classification Search
CPC ..... D05C 1/00; D05B 91/00; D05B 97/00; D05B 97/02; D04B 37/00; D04B 3/00; D04B 33/00; D04B 35/00; G06M 1/083; G06M 1/02; G06M 1/08; D05D 2305/345; D05D 2350/34
USPC ..... 66/1 R, 1 A
See application file for complete search history.

(56) References Cited

U.S. PATENT DOCUMENTS 2,276,062 A * 3/1942 Peyser ..... G06M 1/00 235/114
2,486,184 A * 10/1949 Marker et al. ..... D04B 3/02 66/117
2,588,935 A * 3/1952 Oran ..... H04M 15/30 235/117 R
2,887,858 A * 5/1959 Sanders ..... D04B 17/04 66/117
2,918,035 A * 12/1959 Sanders ..... D04B 3/00 116/317
3,039,684 A * 6/1962 Sanders ..... G06M 1/163 235/117 R
3,983,370 A * 9/1976 Caspi ..... D04B 15/66 700/141
4,107,953 A * 8/1978 Casillo ..... D04B 33/00 112/169
4,343,160 A * 8/1982 Ponthus born Turquet ..... D04B 3/02 66/1 A
4,359,953 A * 11/1982 Martell ..... D05B 69/20 112/275
4,470,273 A * 9/1984 Rogers ..... D04B 3/00 116/312
4,764,943 A * 8/1988 Okada ..... D04B 37/00 377/112
D301,556 S * 6/1989 Okada ..... D10/97
6,112,557 A * 9/2000 Crabtree ..... D04B 35/10 66/125 R (Continued)

FOREIGN PATENT DOCUMENTS

DE 4012123 A * 9/1990
WO WO 8905878 A * 6/1989

*Primary Examiner* — Danny Worrell
(74) *Attorney, Agent, or Firm* — Leavitt Eldredge Law Firm

(57) ABSTRACT

A stitch counting device for assisting users with counting the number of stitches made during stitchwork. The stitch counting device includes a casing, a first prong, a second prong, a display, a microcontroller, one or more fasteners, a fulcrum having a spring, a battery, and an interface input port. Methods for using the stitch counting device are also described.

3 Claims, 4 Drawing Sheets

(56) References Cited

U.S. PATENT DOCUMENTS

| | | | | |
|---|---|---|---|---|
| 7,900,482 | B2 * | 3/2011 | Barry | B26B 11/00 66/1 A |
| 8,615,319 | B2 * | 12/2013 | Felice | D04B 3/02 700/141 |
| 9,188,465 | B1 * | 11/2015 | Jackson | D04B 3/00 |
| 10,711,377 | B2 * | 7/2020 | Christian | D04B 3/00 |
| 2020/0024777 | A1 * | 1/2020 | Moore | D04B 3/00 |

* cited by examiner

STITCH COUNTING DEVICE AND METHOD OF USE

BACKGROUND

1. Field of the Invention

The present invention relates generally to stitches and stitchwork, and more specifically to a stitch counting device that aids users to keep track of the number of stitches made during stitching.

2. Description of Related Art

Stitches and stitchwork are well known in the art and are effective means to construct practical and decorative objects in sewing, knitting, embroidery, crochet, and needle lace-making. Commonly in the art, users generally are required to count the number of stitches made for specific designs. Users may count stiches by mentally keeping track of the number of stitches while actively stitching and/or physically counting the number of stitches using their hands. One of the problems commonly associated with this, however, is that stitch counting is mentally tasking and can lead to mis-shapen designs when stiches are miscounted. Therefore, it would be advantageous to have a stitch counting device that counts the number of stitches made during stitchwork, thereby increasing stitching efficiency.

Accordingly, although great strides have been made in the area of stitches and stitchwork, many shortcomings remain.

DESCRIPTION OF THE DRAWINGS

The novel features believed characteristic of the embodiments of the present application are set forth in the appended claims. However, the embodiments themselves, as well as a preferred mode of use, and further objectives and advantages thereof, will best be understood by reference to the following detailed description when read in conjunction with the accompanying drawings, wherein:

Figure 1A:
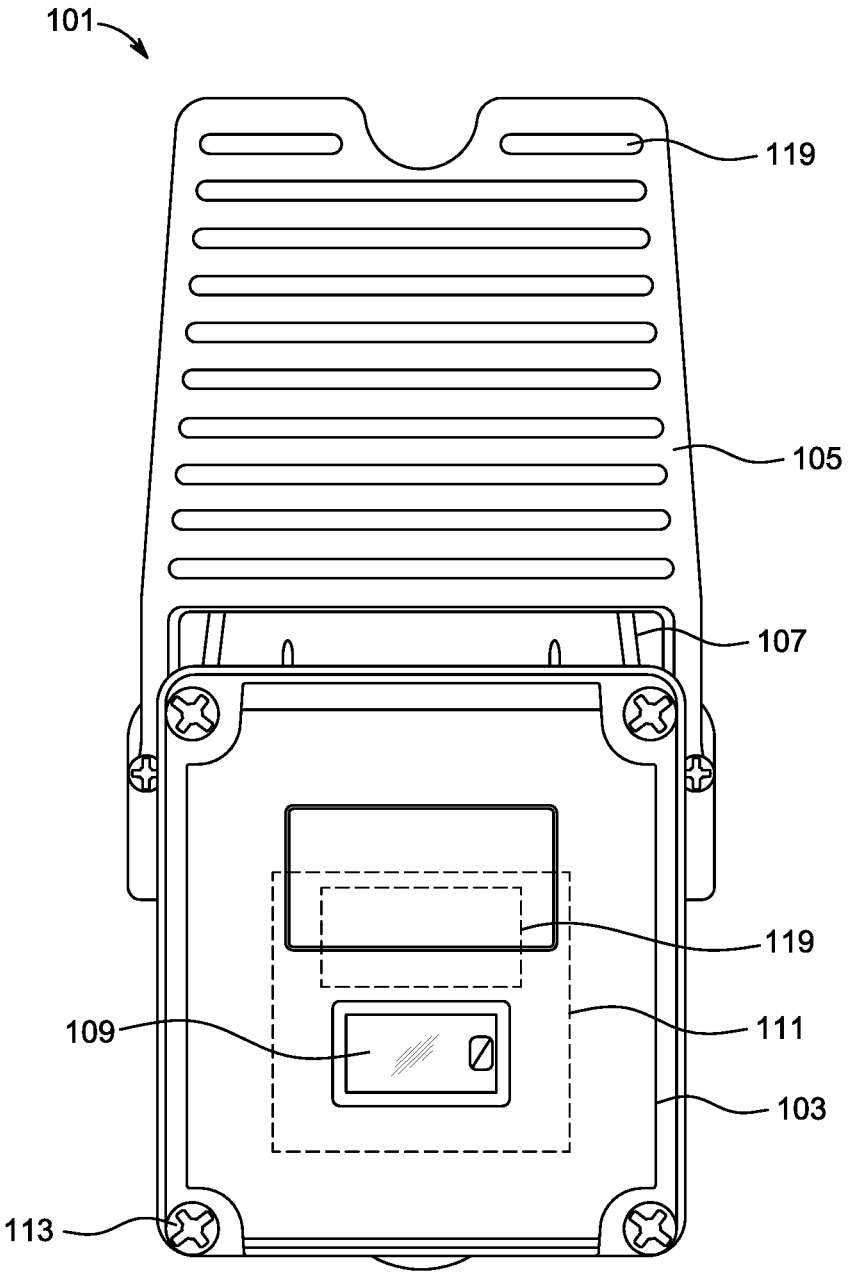
FIG. 1A is a top view of a stitch counting device in accordance with one or more aspects of the present invention.

While the system and method of use of the present application is susceptible to various modifications and alternative forms, specific embodiments thereof have been shown by way of example in the drawings and are herein described in detail. It should be understood, however, that the description herein of specific embodiments is not intended to limit the invention to the particular embodiment disclosed, but on the contrary, the intention is to cover all modifications, equivalents, and alternatives falling within the spirit and scope of the present application as defined by the appended claims.

DETAILED DESCRIPTION OF THE PREFERRED EMBODIMENT

Illustrative embodiments of the system and method of use of the present application are provided below. It will of course be appreciated that in the development of any actual embodiment, numerous implementation-specific decisions will be made to achieve the developer's specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The system and method of use in accordance with the present application overcomes one or more of the above-discussed problems commonly associated with conventional stitchwork. Specifically, the present invention increases stitching efficiency by counting the number of stitches made for users during stitchwork. These and other unique features of the system and method of use are discussed below and illustrated in the accompanying drawings.

The system and method of use will be understood, both as to its structure and operation, from the accompanying drawings, taken in conjunction with the accompanying description. Several embodiments of the system are presented herein. It should be understood that various components, parts, and features of the different embodiments may be combined together and/or interchanged with one another, all of which are within the scope of the present application, even though not all variations and particular embodiments are shown in the drawings. It should also be understood that the mixing and matching of features, elements, and/or functions between various embodiments is expressly contemplated herein so that one of ordinary skill in the art would appreciate from this disclosure that the features, elements, and/or functions of one embodiment may be incorporated into another embodiment as appropriate, unless described otherwise.

The preferred embodiment herein described is not intended to be exhaustive or to limit the invention to the precise form disclosed. It is chosen and described to explain the principles of the invention and its application and practical use to enable others skilled in the art to follow its teachings.

Figure 1B:
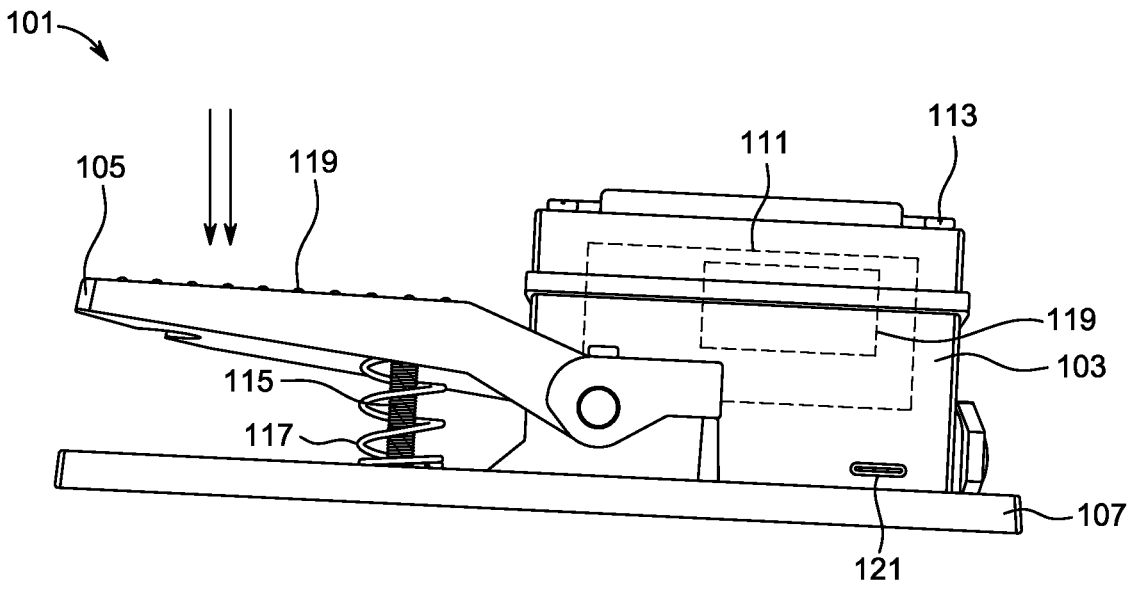
FIG. 1B is a profile view of a stitch counting device in accordance with one or more aspects of the present invention.
Figure 1C:
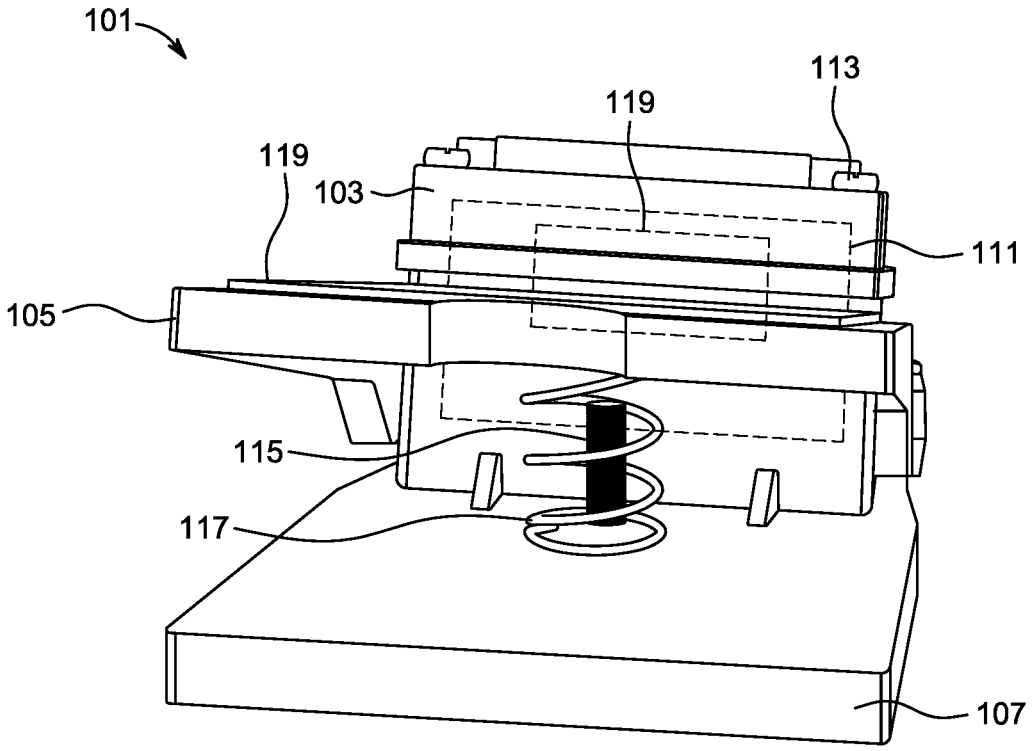
FIG. 1C is a front view of a stitch counting device in accordance with one or more aspects of the present invention.

Referring now to the drawings wherein like reference characters identify corresponding or similar elements throughout the several views, FIGS. 1A, 1B and 1C depict various views of a stitch counting device in accordance with a preferred embodiment of the present application. It will be appreciated that stitch counting device 101 overcomes one or more of the above-listed problems commonly associated with conventional stitching and stitchwork. It should also be appreciated that the stitch counting device 101 may vary based on aesthetical, functional, or manufacturing considerations.

In the contemplated embodiment, the stitch counting device includes a casing 103, a first prong 105, a second prong 107, a display 109, a microcontroller 111, one or more fasteners 113, and a fulcrum 115 having a spring 117. As shown, the casing 103 securely rests on the second prong 107 via the one or more fasteners 113. The first prong 105 engages with the casing 103 via the one or more fasteners 113. The fulcrum 115 and the spring 117 connect the first prong 105 and the second prong 107. The display 109 couples to the top portion of the casing 103.

The casing 103 is configured to house the microcontroller 111 therein. The microcontroller 111 is configured to execute any one or more of the methodologies described herein. Additionally, the display 109 is configured to exhibit numbers which correspond to the number of times a user presses his or her foot onto the first prong 105. It should be appreciated that the microcontroller 111 and the display 109 are in electronic communication. Likewise, it should be appreciated that the microcontroller 111 and the battery 119 are in electronic communication.

The stitch counting device 101 also includes a battery 119 and an interface input port 121 in electronic communication. It should be appreciated that the battery 119 is also in electronic communication with the microcontroller 111. The interface input port 121 may be a port for connecting to, for example, an alternating current power supply, a Universal Serial Bus (USB) connector, IEEE 1394 interface (FireWire™), or another suitable connector known in the art.

It should be appreciated that although the interface input port 121 is located on the casing 103, it is contemplated that the interface input port 121 may vary in location, size, style, and the like. In addition, it should be appreciated that a user may recharge the battery 119 by connecting the interface input port 109 to an external power source (not shown) via a connector (not shown).

The stitch counting device 101 may also include grip 119 coupled to the top portion of the first prong 105. The grip 119 is configured to provide a non-slip, tacky surface for the user's foot. It should be appreciated that the grip 119 may be made from any suitable or desired materials, including conventional materials known and used in the art, such as rubber materials (e.g., natural or synthetic), polymer materials, leather materials, cord or other fabric material embedded therein, combinations of various materials, and the like.

In addition, it should be appreciated that the one or more fasteners 113 may include, without limitation, bolts, screws, nails, hooks, pins, rivets, lugs, latches, and clamps or any other fastener suitable to couple the casing 103 to the second prong 107 and/or to engage the first prong 105 with the casing 103.

In some embodiments, it should be appreciated that the plurality of fasteners 113 may be eliminated and the casing 103 may couple directly to the top portion of the second prong 107. In addition, the casing 103 may be integrally formed as part of the second prong 107 or it may be separately formed and engaged therewith (e.g., by adhesives or cements; by welding, brazing, soldering, or other fusing techniques; by mechanical connectors; etc.).

During use, a user may utilize the stitch counting device 101 to count the number of stitches made during stitchwork such as sewing, knitting, crocheting, embroidering, or the like. When the user makes a stitch, the user may press his or her foot onto the first prong 105, as shown with directional arrows. Upon pressing the first prong 105, the display 109 will exhibit a number (e.g., one) which corresponds to the number of times the first prong 105 is pressed. Once the user releases the first prong 105, the spring 117 will push the first prong 105 back into its resting position. The display 109 may turn off when the user presses and holds the first prong 105 for a specified amount of time (e.g., 10 seconds) and/or when the user leaves the stitch counting device idle for a specified amount of time (e.g., 5 minutes). The user may reset the stitch counting device 101 by double-pressing the first prong 105.

It should also be appreciated that one of the unique features believed characteristic of the present application is the configuration of the stitch counting device that allows a user to use his or her foot to aid in stitch counting, thereby increasing stickwork efficiency.

Figure 2:
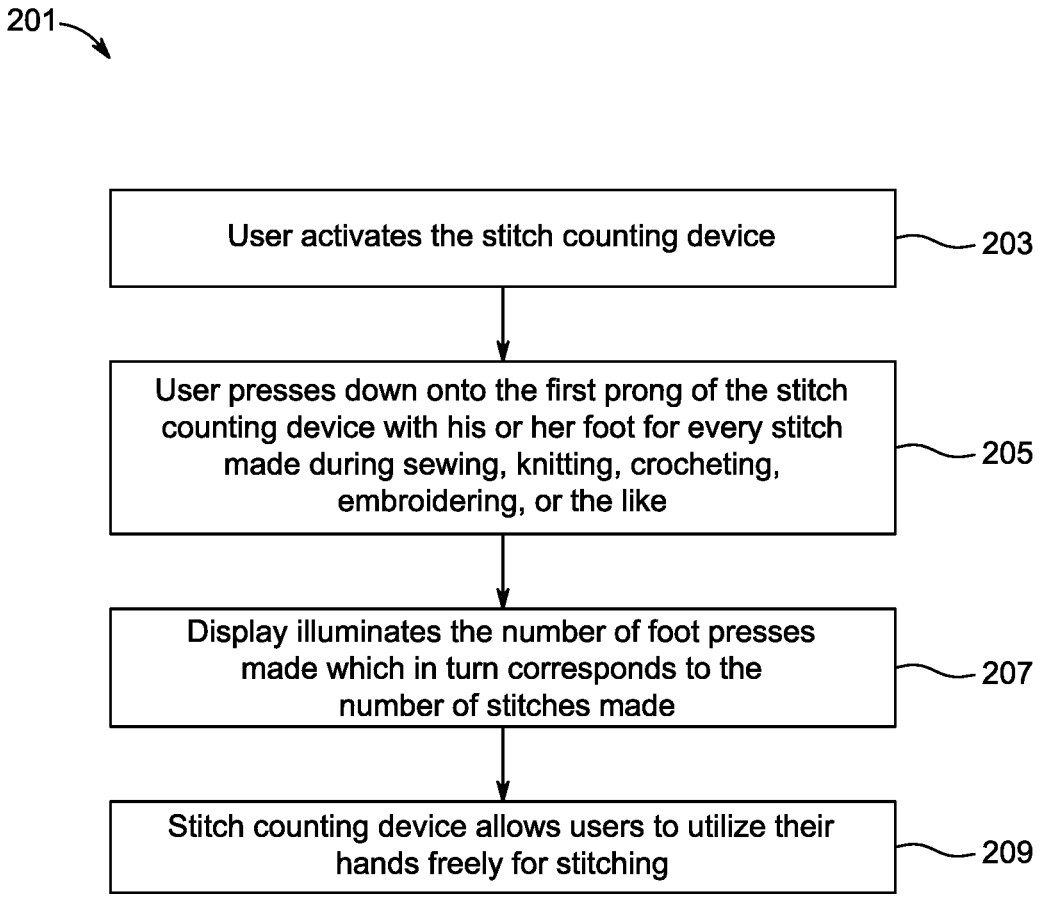
FIG. 2 is a flowchart of a method of use of the stitch counting device of FIGS. 1A, 1B and 1C in accordance with one or more aspects of the present application.

In FIG. 2, a flowchart 201 depicts a simplified method of use associated with the stitch counting device 101. During use, once the user activates the stitch counting device, the user presses down onto the first prong with his or her foot for every stitch made during stitchwork, as shown with boxes 203, 205. Examples of stitchwork include, without limitation, sewing, knitting, crocheting, embroidering, or the like. The display then illuminates the number of foot presses made which in turn corresponds to the number of stitches made, as shown with box 207. The stitch counting device allows users to utilize their hands freely for stitching, as shown with box 209.

The particular embodiments disclosed above are illustrative only, as the embodiments may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. Although the present embodiments are shown above, they are not limited to just these embodiments, but are amenable to various changes and modifications without departing from the spirit thereof.

What is claimed is:

1. A stitch counting device, comprising:
- a casing housing a microcontroller therein;
- a display configured to present information;
- a first prong;
- a second prong;
- one or more fasteners;
- a fulcrum having a spring;
- a battery; and
- an interface input port configured to receive a connector in electronic communication with an external power source and configured to receive power from the external power source when the connector is connected to the interface input port and the external power source;
- wherein the first prong couples to the casing via the one or more fasteners;
- wherein the first prong couples to the second prong via the fulcrum;
- wherein the casing securely rests on the second prong via the one or more fasteners;
- wherein the display couples to the top portion of the casing;
- wherein the microcontroller and the display are in electronic communication;
- wherein the microcontroller and the battery are in electronic communication; and
- wherein the battery and the interface input port are in electronic communication.

2. The stitch counting device of claim 1, wherein the first prong includes grip configured to provide a non-slip surface.

3. A method of counting the number of stitches made during stitchwork, the method comprising:
- providing a stitch counting device, the stitch counting device comprising:
  - a casing housing a microcontroller therein;
  - a display configured to present information;
  - a first prong;
  - a second prong;
  - one or more fasteners; and
  - a fulcrum having a spring;
  - a battery; and
  - an interface input port configured to receive a connector in electronic communication with an external power source and configured to receive power from the external power source when the connector is connected to the interface input port and the external power source;

wherein the first prong couples to the casing via the one or more fasteners;

wherein the first prong couples to the second prong via the fulcrum;

wherein the casing securely rests on the second prong via the one or more fasteners;

wherein the display couples to the top portion of the casing;

wherein the microcontroller and the display are in electronic communication;

wherein the microcontroller and the battery are in electronic communication; and wherein the battery and the interface input port are in electronic communication; and pressing onto the first prong for each stitch made during stitchwork;

wherein the display exhibits the number of times the first prong is pressed.

* * * * *